US010061242B2

(12) United States Patent
Tanaka

(10) Patent No.: US 10,061,242 B2
(45) Date of Patent: Aug. 28, 2018

(54) FIXING DEVICE

(71) Applicant: CANON KABUSHIKI KAISHA, Tokyo (JP)

(72) Inventor: Kenichi Tanaka, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/472,540

(22) Filed: Mar. 29, 2017

(65) Prior Publication Data

US 2017/0199486 A1 Jul. 13, 2017

Related U.S. Application Data

(63) Continuation of application No. PCT/JP2015/078417, filed on Sep. 30, 2015.

(30) Foreign Application Priority Data

Sep. 30, 2014 (JP) ..... 2014-200047

(51) Int. Cl.
*G03G 15/20* (2006.01)

(52) U.S. Cl.
CPC ..... *G03G 15/2067* (2013.01); *G03G 15/2078* (2013.01); *G03G 15/2085* (2013.01)

(58) Field of Classification Search
CPC ..... G03G 15/2067; G03G 15/2078; G03G 15/2085; G03G 15/2017
See application file for complete search history.

(56) References Cited

U.S. PATENT DOCUMENTS

| | | | | |
|---|---|---|---|---|
| 7,106,986 | B2 | 9/2006 | Nakayama | |
| 8,655,242 | B2 | 2/2014 | Tanaka | |
| 8,811,838 | B2 | 8/2014 | Yamada | |
| 9,069,299 | B2 | 6/2015 | Tanaka | |
| 9,317,010 | B2 | 4/2016 | Nakamura et al. | |
| 9,354,562 | B2 | 5/2016 | Tanaka | |
| 9,519,267 | B2 | 12/2016 | Nakamura et al. | |
| 2012/0224869 | A1* | 9/2012 | Yamada | G03G 15/2017 399/33 |
| 2013/0108298 | A1* | 5/2013 | Chiyoda | G03G 15/2028 399/69 |

(Continued)

FOREIGN PATENT DOCUMENTS

| | | | |
|---|---|---|---|
| JP | 2006-119430 | A | 5/2006 |
| JP | 2007-328161 | A | 12/2007 |

(Continued)

OTHER PUBLICATIONS

PCT International Search Report and Written Opinion dated Dec. 15, 2015, in PCT/JP2015/078417.

(Continued)

*Primary Examiner* — Sandra Brase
(74) *Attorney, Agent, or Firm* — Fitzpatrick, Cella, Harper & Scinto

(57) ABSTRACT

In a fixing device, a windbreak plate 908 for suppressing movement of air by a cooling fan 903 toward a thermistor 912 is provided. This windbreak plate 908 is, when a fixing roller 910 and a pressing roller 920 are spaced from each other, disposed opposed to the pressing roller 920 with a distance narrower than an opposing distance between an entrance guide 905 and the pressing roller 920.

8 Claims, 10 Drawing Sheets

(56) References Cited

U.S. PATENT DOCUMENTS

| | | | | |
|---|---|---|---|---|
| 2014/0079455 | A1* | 3/2014 | Seki | G03G 15/2053 399/329 |
| 2015/0063858 | A1 | 3/2015 | Nakamura et al. | |
| 2015/0241823 | A1* | 8/2015 | Fukai | G03G 15/2032 399/70 |
| 2017/0075302 | A1 | 3/2017 | Nakamura et al. | |
| 2017/0192387 | A1 | 7/2017 | Tanaka | |

FOREIGN PATENT DOCUMENTS

| | | | |
|---|---|---|---|
| JP | 2010-181468 | A | 8/2010 |
| JP | 2010-204551 | A | 9/2010 |
| JP | 2012-185276 | A | 9/2012 |
| JP | 2013-033148 | A | 2/2013 |
| JP | 2013-148670 | A | 8/2013 |
| JP | 2013-190627 | A | 9/2013 |
| JP | 2014-029413 | A | 2/2014 |

OTHER PUBLICATIONS

Office Action dated Apr. 10, 2018, issued in Japanese Patent Application Publication No. 2014-200047.

* cited by examiner

FIXING DEVICE

This application is a continuation of PCT Application No. PCT/JP2015/078417, filed on Sep. 30, 2015.

TECHNICAL FIELD

The present invention relates to a fixing device for fixing a toner image on a recording material.

BACKGROUND ART

In an apparatus described in Japanese Laid-Open Patent Application 2006-119430, air blowing from a cooling fan toward a pressing roller in a stand-by state in which the pressing roller is spaced from a fixing roller is proposed. At this time, a temperature of the fixing roller is controlled using a temperature sensor.

However, in a device disclosed in Japanese Laid-Open Patent Application 2006-119430, there is a liability that air by the cooling fan has an influence on a detected temperature by the temperature sensor, and temperature control of the fixing roller cannot be properly carried out.

SUMMARY OF THE INVENTION

Problem to be Solved by the Invention

An object of the present invention is to provide a fixing device capable of properly carrying out temperature control of a fixing roller.

Means for Solving the Problem

According to the present invention, there is provided a fixing device comprising: a rotatable heating member and a rotatable pressing member for forming a nip for fixing a toner image on a recording material; a detecting portion for detecting a temperature of the rotatable heating member; a guiding portion for guiding the recording material toward the nip while sliding on a back surface of the recording material; a moving mechanism for moving the rotatable pressing member relative to the rotatable heating member and the guiding portion so that the rotatable pressing member moves between a first position where the rotatable pressing member contacts the rotatable heating member and a second position where the rotatable pressing member is spaced from the rotatable heating member and is further spaced from the guiding portion; an air blowing portion for blowing air toward the rotatable pressing member from a side, with respect to a recording material feeding path including the nip, where the rotatable pressing member is provided; and a suppressing portion for suppressing blowing of the air by the air blowing portion toward the detecting portion, the suppressing portion being provided opposed to the rotatable pressing member with a distance narrower than a distance between the rotatable pressing member taking the second position and the guiding member.

Effect of the Invention

According to the present invention, there is provided the fixing device capable of properly carrying out the temperature control of the fixing roller.

EMBODIMENTS FOR CARRYING OUT THE INVENTION

Embodiment 1

In the following, with reference to the drawings, an Embodiment of the present invention will be described specifically.

(Image Forming Apparatus)

Figure 1:
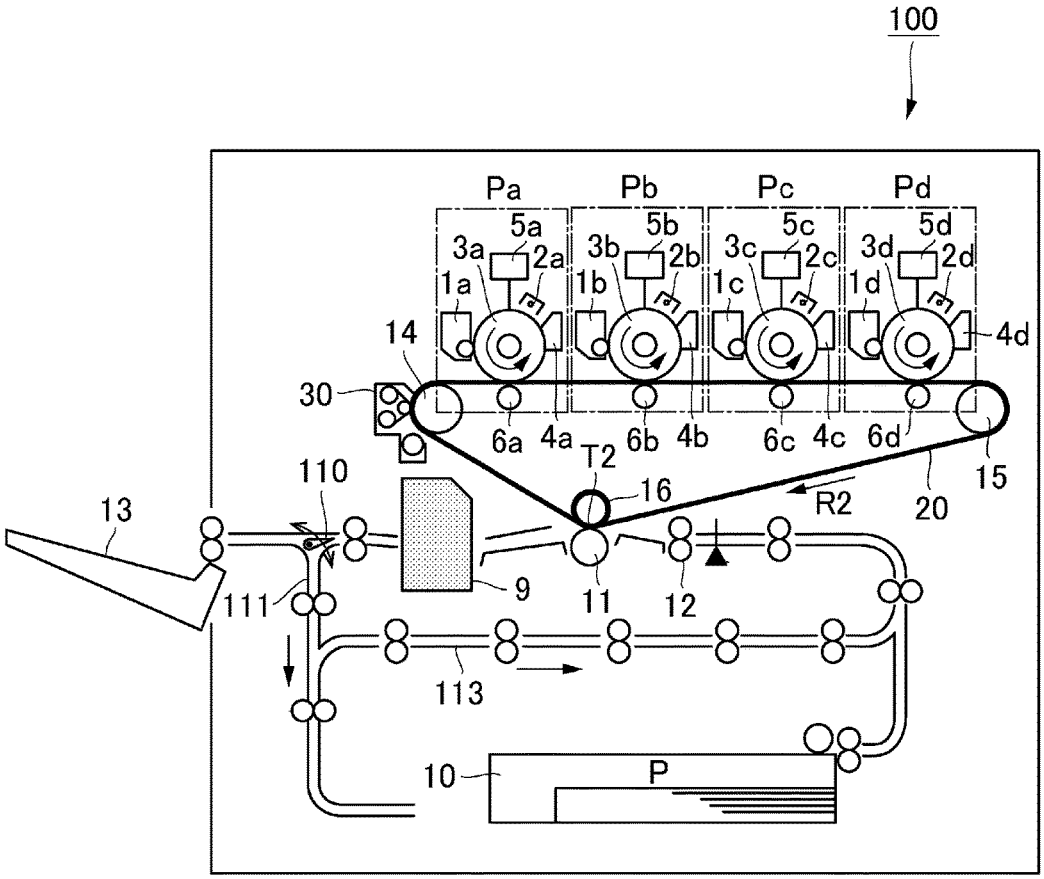
FIG. 1 is an illustration of a structure of an image forming apparatus.

FIG. 1 is an illustration of a structure of an image forming apparatus. As shown in FIG. 1, an image forming apparatus 100 is a tandem-type full-color printer of an intermediary transfer type in which image forming apparatus Pa, Pb, Pc, Pd of yellow, magenta, cyan, black are arranged along an intermediary transfer belt 20.

At the image forming portion Pa, a yellow toner image is formed on a photosensitive drum 3*a* and is primary-transferred onto the intermediary transfer belt 20. At the image forming portion Pb, a magenta toner image is formed on a photosensitive drum 3*b* and is primary-transferred onto the intermediary transfer belt 20. At the image forming portion Pc and Pd, a cyan toner image and a black toner image on the photosensitive drums 3*c* and 3*d*, respectively, and are primary-transferred onto the intermediary transfer belt 20.

A recording material (recording material) P is taken out one by one from a cassette 10 and is on stand-by at a registration roller 12. The recording material P is fed by the registration roller 12 to a secondary transfer portion T2 in timing with the toner images on the intermediary transfer belt 20, and the toner images are secondary-transferred onto the recording material P. The recording material P on which the toner images of the four colors are secondary-transferred is fed to a fixing device 9 and is heated and pressed by the fixing device 9, so that an image is fixed on the recording material P, and thereafter is discharged on a tray 13.

In double-side printing, the recording material on which the images are fixed at a front surface thereof by the fixing device 9 is sent into a reverse feeding path 111 and is switched back, and then passes through a feeding path 113 in a state in which a leading end and a trailing end are reversed and in which the front surface and a back surface are reversed, and is on stand-by at the registration roller 12. Then, the recording material is fed again to the secondary transfer portion T2, where the toner images are transferred onto the back surface of the recording material and are fixed on the back surface of the recording material by the fixing device 9, and thereafter, the recording material is discharged on the tray 13 at an outer portion of the apparatus (printer).

(Image Forming Portion)

The image forming portions Pa, Pb, Pc, Pd have substantially the same constitution except that the colors of the toners used in developing devices 1*a*, 1*b*, 1*c*, 1*d* are yellow, magenta, cyan, black which are different from each other. In the following, the image forming portion Pa for yellow will be described, and redundant description relating to other image forming portions Pb, Pc, Pd will be omitted.

At the image forming portion Pa, at a periphery of the photosensitive drum 3*a*, a corona charger 2*a*, an exposure device 5*a*, the developing device 1*a*, a transfer roller 6*a* and a drum cleaning device 4*a* are provided.

The corona charger 2*a* electrically charges a surface of the photosensitive drum 3*a* to a uniform potential. The exposure device 5*a* writes the electrostatic image for the image on the photosensitive drum 3*a* by scanning the photosensitive drum surface with a laser beam. The developing device 1*a* develops the electrostatic image into the toner image on the photosensitive drum 3*a* by transferring the toner on the electrostatic image on the photosensitive drum 3*a*. The transfer roller 6*a* primary-transfers the toner image from the photosensitive drum 3*a* onto the intermediary transfer belt 20 under application of a voltage of an opposite polarity to a charge polarity of the toner.

The intermediary transfer belt 20 is extended around and supported by a tension roller 14, a driving roller 15 and an opposing roller 16, and is driven by the driving roller 15, so that the intermediary transfer belt 20 rotates in an arrow direction. A secondary transfer roller 11 press-contacts the intermediary transfer belt 20 supported by the opposing roller 16 and forms the secondary transfer portion T2. A belt cleaning device 30 rubs the intermediary transfer belt 20 with a cleaning web and thus removes a transfer residual toner passed through the secondary transfer portion T2.

(Fixing Device)

Figure 2:
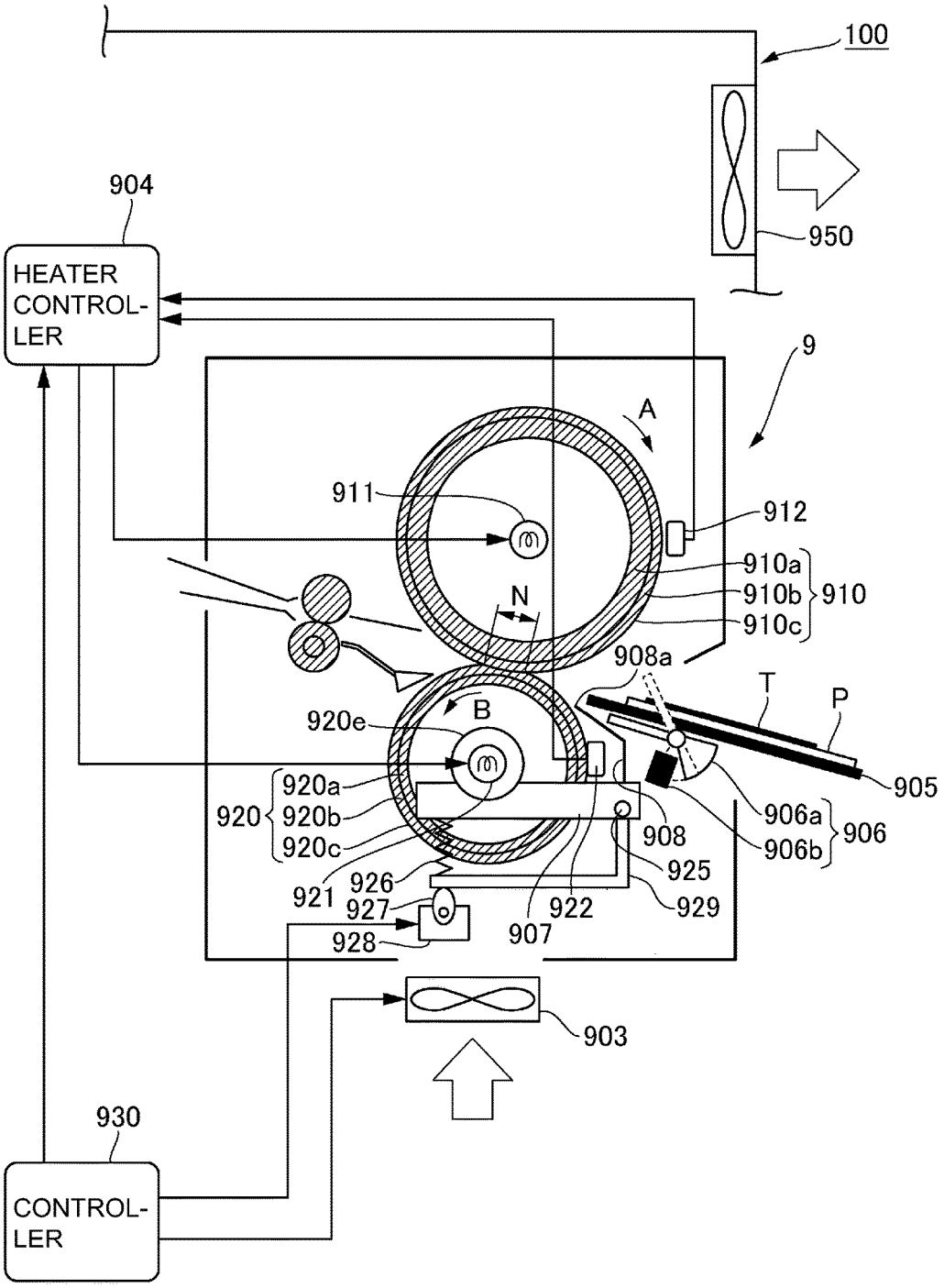
FIG. 2 is an illustration of a structure of a fixing device.

FIG. 2 is an illustration of a structure of the fixing device.

As shown in FIG. 2, the recording material P is guided by an entrance guide 905 and is induced into a fixing nip N, and is nipped and fed by the fixing roller 910 and a pressing roller 920. A toner image T on the recording material P is heated and pressed in a process of passing through the fixing nip N, so that the image is fixed on the surface of the recording material P.

The fixing roller 910 which is an example of a first rotatable member (rotatable heating member) contacts a toner image carrying surface of the recording material and heats the recording material. The fixing roller 910 includes a core metal 910*a* formed with a pipe member of aluminum, iron or the like and an elastic layer 910*b* which is disposed in an outer side of the core metal 910*a* and which is formed with a heat-resistant elastic member of a silicone rubber, a fluorine-containing rubber or the like, and the surface of the elastic layer 910*b* is coated with a parting layer 910*c* of a fluorine-containing material such as PFA or PTFE.

The fixing roller 910 is rotated in an arrow A direction by an unshown driving mechanism. The pressing roller 920 is disposed so that the pressing roller 920 can press-contact the fixing roller 910 and can be spaced from the fixing roller 910, and press-contacts the fixing roller 910 and thus forms the fixing nip N, so that the pressing roller 920 is rotated in an arrow B direction by the fixing roller 910.

The pressing roller 920 which is an example of a second rotatable member (rotatable pressing member) forms the fixing nip N, which is an example of a recording material nip, between itself and the fixing roller 910. The pressing roller 920 includes, similarly as the fixing roller 910, a core metal 920*a* formed with a pipe member, an elastic layer 920*b* of a heat-resistant elastic member disposed in an outer side of the core metal 920*a*, and a parting layer 920*c* of a fluorine-containing resin material coated on a surface of the elastic layer 920*b*.

A positional relationship of the entrance guide 905 which is an example of a guiding portion is fixed relative to the fixing roller 910, and the entrance guide 905 contacts a surface of the recording material in a side opposite from a toner image carrying surface and guides the recording material into the fixing nip N. A recording material detecting portion 906 is provided below the entrance guide 905 and detects passing of the recording material P. The recording material detecting portion 906 is constituted by a detecting flag 906*a* and a photo-interruptor 906*b*, and when the recording material P passes through the detecting flag 906*a*, the detecting flag 906*a* falls down, so that the photo-interruptor 906*b* detects transmitted light and thus detects the passing of the recording material P.

Inside the fixing roller 910, a heater 911 as a heating portion is provided. The heater 911 radiates infrared rays by energization and heats the fixing roller 910 from an inside of the fixing roller 910. Further, a thermistor 912 as a detecting portion is provided spaced from the fixing roller 910. The thermistor 912 detects a surface temperature of the fixing roller 910. A heater controller (control portion) 904 effects ON/OFF control of electric power supply to the heater 911 on the basis of an output of the thermistor 912, and maintains the surface temperature of the fixing roller 910 at a target temperature (printing temperature) during fixing or a waiting (stand-by) temperature during non-fixing. The heater controller 904 controls the electric power supply to the heater 911 on the basis of the surface temperature detected by the thermistor 912, and maintains the surface temperature of the fixing roller 910 at a temperature suitable for fixing of the toner.

Also as regards the pressing roller 920, similarly, a heater 921 is provided non-rotatably, and a thermistor 922 is provided. The heater controller 904 effects ON/OFF control of electric power supply to the heater 921 on the basis of an output of the thermistor 922, and maintains the surface temperature of the pressing roller 920 at a target temperature lower than the target temperature of the fixing roller 910*a*. The heater controller 904 controls the electric power supply to the heater 921 on the basis of the surface temperature detected by the thermistor 922, and maintains the surface temperature of the pressing roller 920 at a temperature at which the fixed image is melted again.

As shown in FIG. 1, in the case of the double-side printing, the recording material on which a first surface image is fixed by the fixing device 9 is guided into the reverse feeding path 111 by a flapper 110, and the toner image is transferred onto a second surface and then the image is fixed by the fixing device 9. In this case, when the surface temperature of the pressing roller 920 is excessively high, there is a possibility that the first surface image contacts the pressing roller 920 and is melted again and thus is disturbed. For this reason, relative to the surface temperature of the fixing roller 910, the surface temperature of the pressing roller 920 is set at a lower value.

Here, in the case where the image forming apparatus wait for image formation of plain paper, temperature control is effected on the basis of temperature detection results of the thermistors 912 and 922 so that the target temperature of the fixing roller 910 is 170° C. and the target temperature of the pressing roller 920 is 100° C.

Incidentally, in order to detect the surface temperature of the fixing roller 910, conventionally, the thermistor was disposed in contact with the surface of the fixing roller 910. However, in this case, during rotation of the fixing roller 910, the thermistor continuously rubs the surface of the fixing roller 910, so that when a foreign matter is deposited on a rubbing portion, rubbing scars undesirably generate on the fixing roller 910. Further, whether or not the rubbing scars generated on the fixing roller 910 and the pressing roller 920 are transferred onto a fixed image largely depends on the surface temperatures of the fixing roller 910 and the pressing roller 920. The fixing roller 910 is high in surface temperature during the fixing process, and therefore, there is a tendency that the rubbing scars are transferred onto the fixed image and are conspicuous. For that reason, in Embodiment 1, the thermistor of a non-contact type is disposed with a gap of 50 μm from the surface of the fixing roller 910.

On the other hand, the pressing roller 920 is low in surface temperature, and therefore, the rubbing scars are not readily transferred onto the fixed image. For this reason, in order to detect the surface temperature of the pressing roller 920, in Embodiment 1, the thermistor 922 of a contact type is used as before.

The thermistor 912 which is an example of a detecting portion detects the temperature of the fixing roller 910 at a position where the thermistor 912 is close to or contacts the peripheral surface of the fixing roller 910. The thermistor 922 which is an example of a second rotatable member temperature detecting portion detects the temperature of the pressing roller 920 at a position where the thermistor 922 is close to or contacts the peripheral surface of the pressing roller 920. The heater controller 904 which is an example of a temperature controller controls heating of the fixing roller 920 on the basis of an output of the thermistor 912. The heater controller 904 controls heating of the fixing roller 910 on the basis of an output of the thermistor 922.

(Contact-and-Separation Mechanism)

Figure 3:
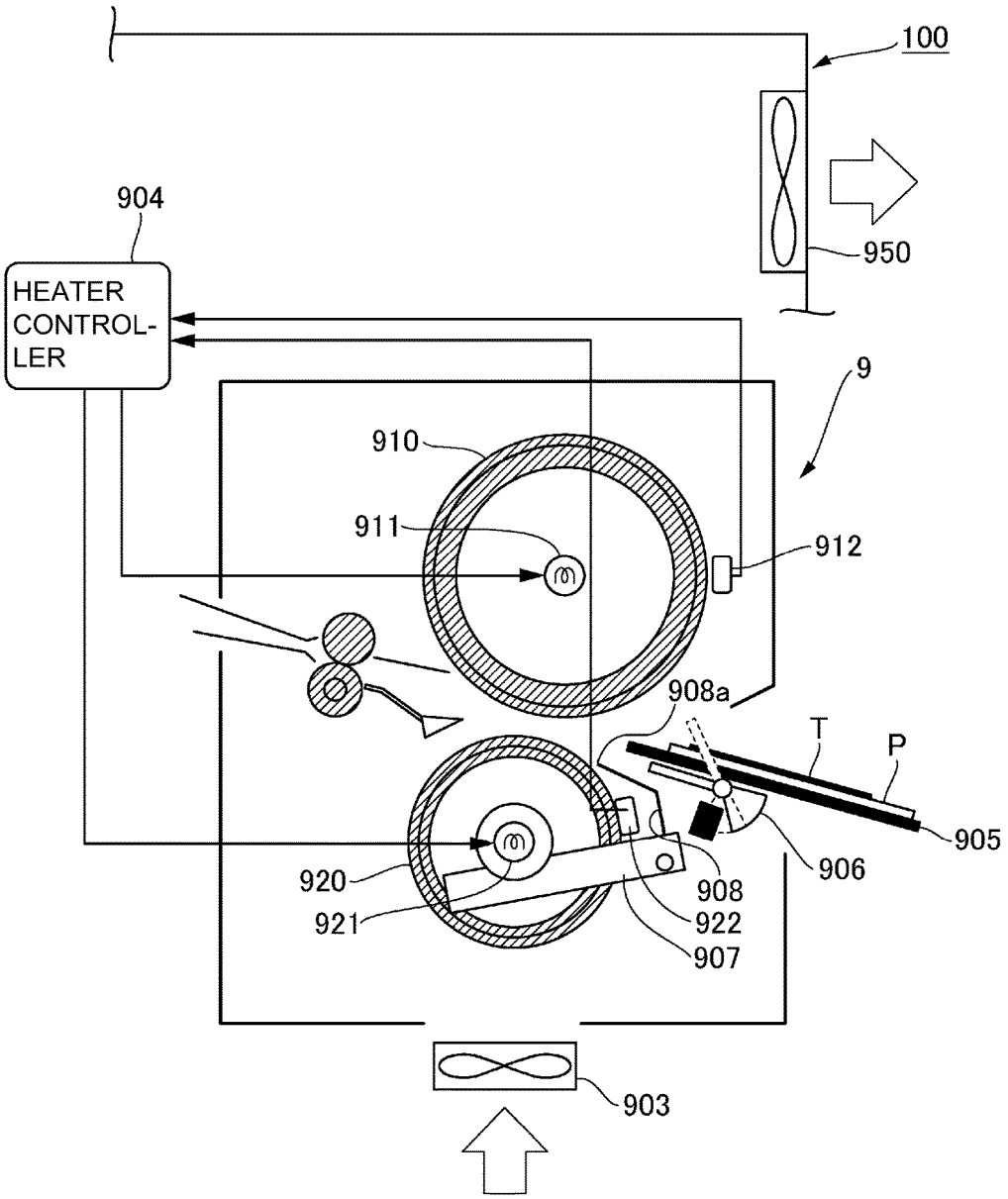
FIG. 3 is an illustration of the fixing device in a stand-by state.

FIG. 3 is an illustration of the fixing device in the stand-by state. As shown in FIG. 3, when the fixing device 9 awaits in the stand-by state in which image fixing on the plain paper can be immediately started, the pressing roller 920 is spaced from the fixing roller 910. This is because when a state in which the pressing roller 920 press-contacts the fixing roller 910 is maintained, heat is conducted from the fixing roller 910 high in temperature to the pressing roller 920 low in temperature, and the temperature of the pressing roller 920 cannot be maintained at 100° C.

As shown in FIG. 2, the pressing roller 920 moves between a press-contact position and a spaced position relative to the fixing roller 910 with rotational movement of a pressing arm 907 as a contact-and-separation mechanism (moving mechanism).

Bearings 920*e* rotatably supporting both end portions of the pressing roller 920 are fixed to the pressing arms 907 rotatable about rotation shafts 925. Each pressing arm 907 is moves a rotational movement end upward and downward via a pressing spring 926 by rotating a pressing cam 927 by a driving motor 928.

A controller 930 controls the driving motor 928 and rotates the pressing arm 907, and thus switches press-contact and spacing of the pressing roller 920 relative to the fixing roller 910. The controller 930 which is an example of a contact-and-separation portion causes the pressing roller 920 to be spaced from the fixing roller 910 and causes these rollers to wait for the heating process, and the controller 930 causes the fixing roller 910 and the pressing roller 920 to contact each other and starts the heating process of the recording material. The controller 930 causes the pressing roller 920 to press-contact the fixing roller 910 at timing immediately before feeding of the recording material, on which the toner image is transferred, to the fixing device 9, so that the fixing nip N is formed. Further, the controller 930 maintains the press-contact state during continuous passing of the recording material through the fixing nip N. When a series of fixing processes of the recording materials is ended, the controller 930 spaces the pressing roller 920 from the fixing roller 910 at timing when a final recording material passes through the fixing nip N.

In a period in which the fixing device 9 maintains a stand-by state, the controller 930 rotationally moves the pressing arm 907 downward as shown in FIG. 3, and wait in a state in which the pressing roller 920 is spaced from the fixing roller 910.

(Cooling Fan)

As shown in FIG. 2, below the fixing device 9, a cooling fan 903 for blowing air toward the pressing roller 920 is provided. The cooling fan 903 which is an example of the air blowing portion blows the air toward the pressing roller 920. The cooling fan 903 is an axial fan, and blows the air introduced through an unshown air filter to the pressing roller 920 and forms an air flow (air current) along a peripheral surface of the pressing roller 920, and thus cools the pressing roller 920.

An exhaust fan 950 exhausts the air, to an outside, inside a casing of the image forming apparatus 100 in which the fixing device 9 is disposed, so that heat of the fixing device 9 heated by the heaters 911 and 921 is prevented from being accumulated in the casing of the image forming apparatus 100.

When the target temperature for temperature adjustment of the fixing roller 910 is changed, thereafter, until the surface temperature of the fixing roller 910 converges to a new target temperature, image formation is interrupted and downtime generates. Here, in the case where the target temperature is changed to a high value, by increasing supplied electric power for heating the fixing roller 910, the downtime can be quickly eliminated. However, in the case where the target temperature is lowered, when the fixing roller 910 waits for natural cooling, the downtime endlessly elongates. Therefore, in Embodiment 1, the pressing roller 920 air-cooled by the cooling fan 903 is press-contacted to the fixing roller 910, so that a temperature lowering of the fixing roller 910 is promoted. In the case where the target temperature for temperature adjustment of the fixing roller 910 is lowered, the controller 930 causes the pressing roller 920 to press-contact the fixing roller 910 and to rotate the pressing roller 920, and at the same time, turns on the cooling fan 903 and thus cools the pressing roller 920, so that the fixing roller 910 is forcedly cooled.

Further, in the case where the target temperatures of the fixing roller 910 and the pressing roller 920 are different from each other, heat is conducted from the fixing roller 910 high in target temperature to the pressing roller 920 low in target temperature during printing, and the surface temperature of the pressing roller 920 exceeds the target temperature thereof. Therefore, in Embodiment 1, the air is blown from the cooling fan 903 to the pressing roller 920 during the printing, so that forced cooling is carried out. The controller 920 forcedly cools the pressing roller 920 by blowing the air toward the pressing roller 920 in the case where the surface temperature of the pressing roller 920 detected by the thermistor 922 increases by a certain temperature relative to the target temperature in a continuous fixing process. The controller 930 which is an example of an air blowing controller controls the cooling fan 903 on the basis of an output of the thermistor 922.

(Control of Fixing Device)

Figure 4:
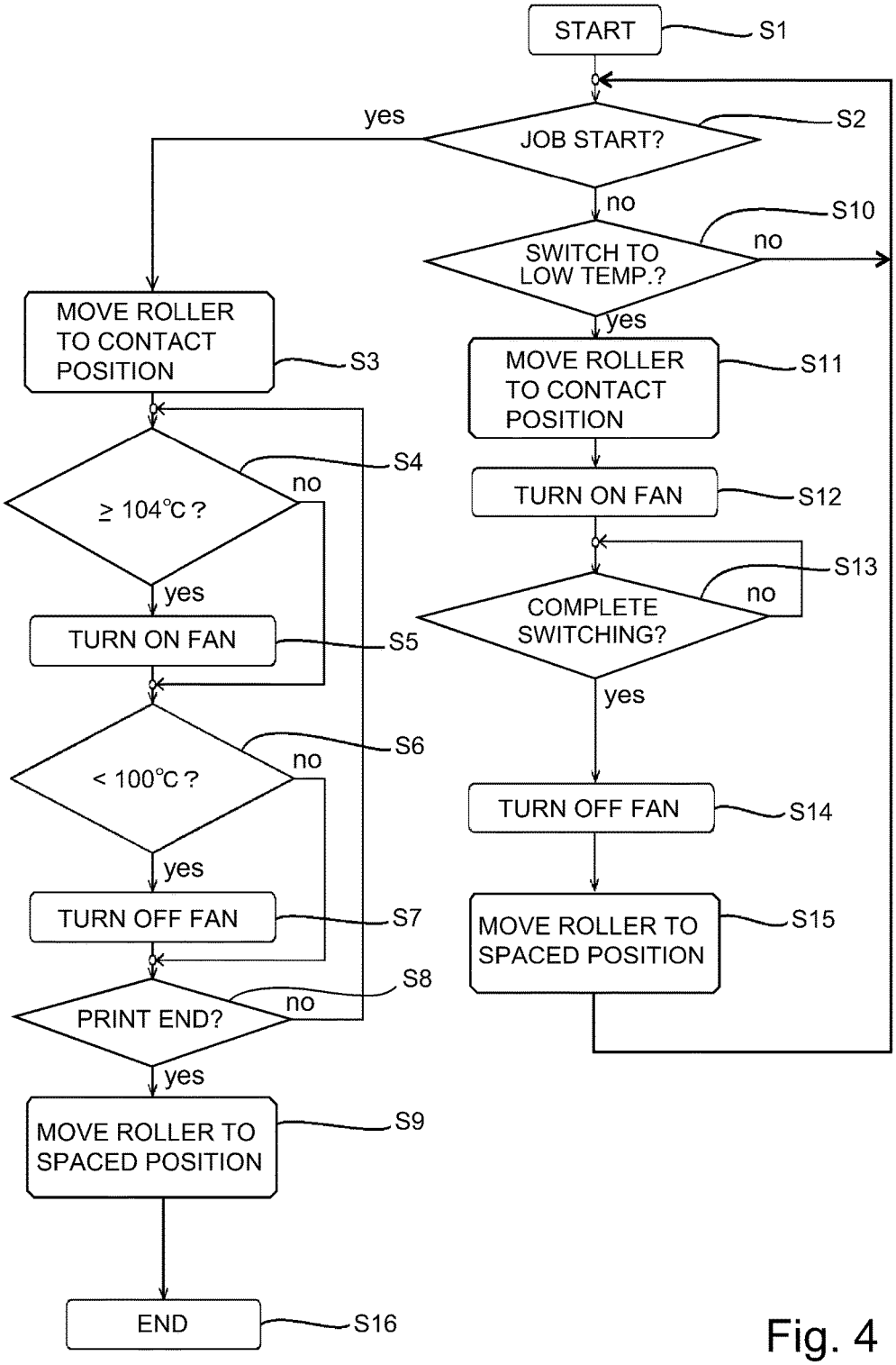
FIG. 4 is a flowchart of control of the fixing device.

FIG. 4 is a flowchart of the control of the fixing device.

As shown in FIG. 4 with reference to FIG. 2, the fixing device 9 waits for a start of image formation in the image forming apparatus (100: FIG. 1) in a state in which the pressing roller 920 is spaced from the fixing roller 910 and these rollers are maintained at the respective target temperatures. When data of a print job are sent from an external computer or the like (S1), the image forming apparatus (100) carries out image formation designated by the print job.

When a detection temperature of the thermistor 912 falls within a range of ±1° C. with respect to the target temperature of the fixing roller 910 for the recording material designated by the print job, the controller 930 discriminates that the job can be started (yes of S2).

The controller 930 causes the pressing roller 920 to press-contact the fixing roller 910, so that the fixing nip N is formed (S3).

Thereafter, the toner images are formed at the image forming portions Pa, Pb, Pc, Pd, and the recording materials on which the toner images are transferred are successively sent into the fixing device 9, so that the images are fixed on the recording materials. During execution of the continuous fixing process, when the heating process of thin paper is continued, heat of the fixing roller 910 excessively flows into the pressing roller 920, so that the surface temperature of the pressing roller 920 exceeds the target temperature of 100° C. in some cases.

For that reason, when a detection temperature of the thermistor 922 exceeds 104° C. (yes of S4), the controller 930 turns on the cooling fan 903 (S5), and when the cooling is successful and the detection temperature is below 100° C. (yes of S6), the controller 930 turns off the cooling fan 903 (S7). Thus, by controlling the cooling fan 903, the continuous recording material fixing process is continued.

When the image formation (print-out) designated by the job is ended (yes of S8), the controller 930 moves the pressing roller 920 from the fixing roller 910 to the spaced position and goes to a stand-by state (S9). At this time, when the cooling fan 903 rotates, the cooling fan 903 is turned off at the time when the detection temperature of the thermistor 922 is below 100° C.

The controller 930 discriminates that the job cannot be started unless the detection temperature of the thermistor 912 falls within the range of ±1° C. with respect to the target temperature of the fixing roller 910 for the recording material designated by the print job (no of S2).

In the case where the recording material designated by the print job requires a change in target temperature for temperature adjustment of the fixing roller 910 (no of S2), the controller 930 discriminates whether the target temperature should be raised or lowered (S10). In the case where thick paper having a large weight per unit area is designated, the target temperature is raised. In the case where the target temperature is raised (no of S10), when the surface temperature of the fixing roller 910 reaches a new target temperature (yes of S2), the controller 930 causes the pressing roller 920 to press-contact the fixing roller 910, so that the fixing nip N is formed (S3).

In the case where thin paper having a small weight per unit area is designated, the target temperature is lowered. However, in the case where the target temperature is lowered (yes of S10), even when the heater 911 is turned off, the temperature of the fixing roller 910 is not readily lowered only by natural heat dissipation.

For this reason, the controller 930 causes the pressing roller 920, which is relatively cool, the press-contact the fixing roller 910, so that the fixing roller 910 is forcedly cooled from the surface thereof (S11). Further, the cooling fan 903 is turned on for cooling the pressing roller 920 increased in temperature by being heated by the fixing roller 910 (S12).

When the change in both of the surface temperatures of the fixing roller 910 and the pressing roller 920 to the changed target temperatures is completed (yes of S13), the controller 930 turns off the cooling fan 903 (S14), and moves the pressing roller 920 to the spaced position (S15). By this, switching to a newly set temperature is completed. When the surface temperature of the fixing roller 910 reaches the new target temperature (yes of S2), the controller 930 causes the pressing roller 920 to press-contact the fixing roller 910, so that the fixing nip N is formed (S3).

(Detection Temperature Error of Thermistor)

The temperature sensor for the fixing roller 910 have been required, with regard to either of the contact type and the non-contact type, to be small in thermal capacity and be high in responsiveness with speed-up of a process speed of the image forming apparatus 100. However, the thermistor 912 small in thermal capacity and high in responsiveness sensitively reacts to thermal disturbance. When the cooling fan 903 is actuated and the air is blown to the pressing roller 920, a part of the blown air flows to the thermistor 912 and becomes the thermal disturbance. Particularly, the thermistor 912 of the non-contact type is of a type in which a temperature of a sensor head having a small weight heated by radiant heat generated from the surface of the fixing roller 910 is measured, and therefore, sensitivity is high, so that the influence of the disturbance such as the air flow on the sensor head is very large.

Figure 5:
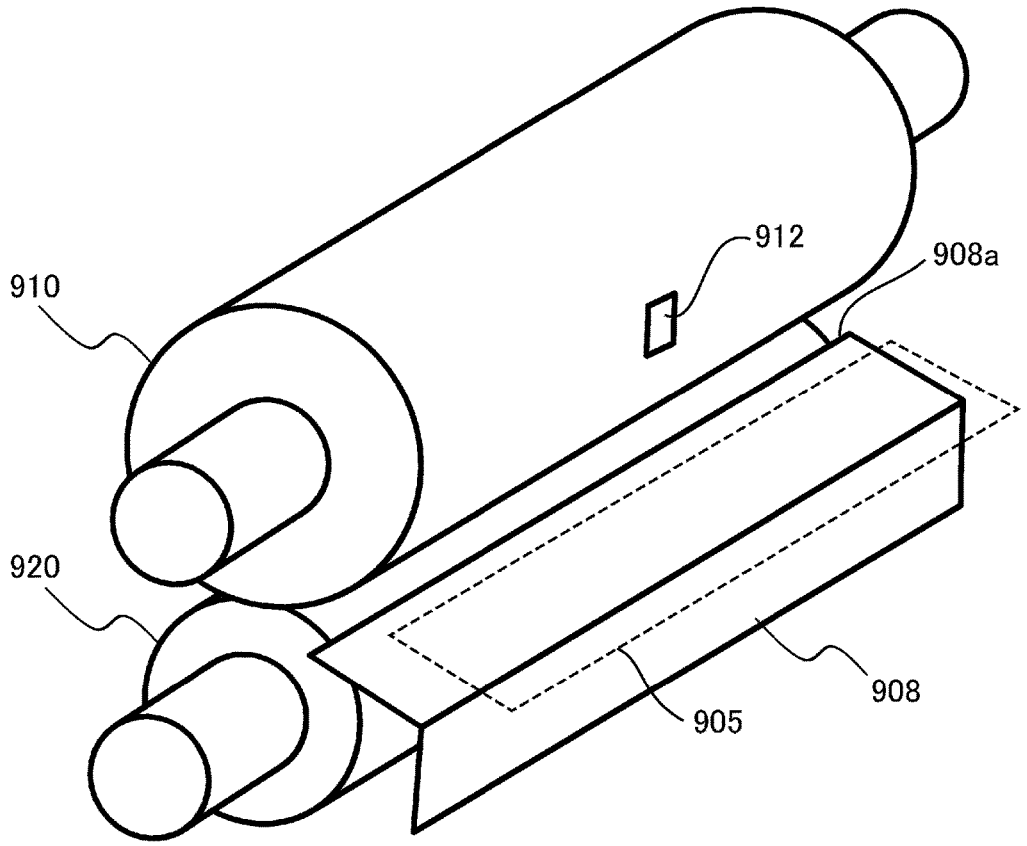
FIG. 5 is an illustration of an arrangement of a windbreak plate in Embodiment 1.

In Embodiment 1, as shown in FIG. 5, when the heating process of thin paper is continued or the like and a detection temperature of the thermistor 922 exceeds 104° C. (yes of S4), the cooling fan 903 is turned on (S5). Then, when the print job is ended (yes of S8), the pressing roller 920 is moved from the fixing roller 910 to the spaced position, and goes to the stand-by state (S9).

At this time, when the detection temperature is 100° C. or more (no of S6), the cooling fan 903 continuously rotates, and therefore, the blowing of the air from the exhaust fan 950 flowing along the pressing roller 920 flows toward the thermistor 912 through a gap, between the pressing roller 920 and the entrance guide 905, enlarged by the spacing. As regards a flow of the cool air, the thermal disturbance is caused to act on the thermistor 912 and the detection temperature is outputted as a low value, and therefore, an actual surface temperature of the fixing roller 910 is adjusted to a value higher than the target temperature.

As a result, immediately after the fixing device goes to the stand-by state (S16), in the case where the image formation in which the fixing process at the same target temperature is carried out is started (yes of S2), the fixing process is carried out by the fixing roller 910 at which an actual surface temperature is higher than the target temperature. By this, there is a possibility that toner offset such that a melted toner is transferred onto the fixing roller 910 is liable to generate. Or, there is a possibility that glossiness of the outputted fixed image varies.

Therefore, in Embodiment 1, the pressing arm 907 provided with a windbreak plate 908 which is an example of a wind shielding member or a plate-like member, so that erroneous toner detection of the thermistor 922 due to the air blowing of the cooling fan 903 is reduced.

(Windbreak Plate)

FIG. 5 is an illustration of an arrangement of the windbreak plate.

As shown in FIG. 2, the windbreak 908 as a suppressing portion 908 is attached to the pressing arm 907 rotatable about a rotation shaft 925. As shown in FIG. 5, a length of the windbreak 908 with respect to a rotational axis direction of the pressing roller 920 is set equally to a length of the pressing roller 920. The windbreak 908 was formed by bending a 0.5 mm-thick plate-like member of aluminum in an L-shape, and the surface thereof was painted black.

As regards the windbreak 908, a closest portion 908*a* close to the pressing roller 920 is formed in substantially parallel to generatrix of the peripheral surface of the pressing roller 920. In the spaced state of the pressing roller 920, the closest portion 908*a* of the windbreak 908 is closer to the surface of the pressing roller 920 than a free end of the entrance guide 905 is.

As shown in FIG. 2, the windbreak plate 908 is mounted to the pressing arm 907, and therefore moves while following the rotational movement operation for the press-contact and the spacing of the pressing roller 920. As a result, the gap between the closest portion (a free end portion in an extension direction), of the windbreak plate 908 and to the pressing roller 920 is kept constant even at the press-contact position and at the spaced position. The closest portion 908*a* is disposed close to the pressing roller 920, and therefore, a wind path of the cooled air sent from the cooling fan 903 is substantially blocked by the windbreak plate 908, so that flowing of the cooled air into the thermistor 912 is suppressed.

The cooled air sent from the cooling fan 903 runs against the windbreak plate 908 passes through both sides of the windbreak plate 908 with respect to the rotational axis direction of the pressing roller 920 toward an upper portion of the fixing device 9 and passes through a gap of a casing and is breathed in the exhaust fan 950. For this reason, the flowing of the cooled air in the thermistor 912 decreases.

The length of the windbreak plate 908 with respect to the recording material feeding direction can be appropriately set depending on a structure of the fixing device 9, an air blowing amount of the cooling fan 903 and responsiveness of the thermistor 912.

On the other hand, the thermistor 922 used for temperature adjustment of the pressing roller 920 is of the contact type and is covered with a heat-insulating material at a periphery thereof, and therefore a difference in detection temperature due to a difference of ON/OFF of the cooling fan 903 is small. For this reason, the windbreak plate 908 was disposed so that the closest portion 908*a* located immediately below the entrance guide 905.

An experiment in which the gap between the closest portion 908*a* of the windbreak plate 908 and the pressing roller 920 was made different at a plurality of stages and an actual surface temperature of the fixing roller 910 temperature-adjusted at the target temperature of 170° C. by the detection temperature of the thermistor 912 was measured was conducted. As a result, it turned out that when the gap between the closest portion 908*a* and the pressing roller 920 surface is 2.0 mm or less, even in the case where the cooling fan 903 is actuated in the spaced state of the pressing roller 920, the actual surface temperature of the fixing roller 910 is temperature-controlled according to the target temperature. That is, when an opposing interval between the windbreak plate 908 and the pressing roller 920 is 2.0 mm or less, the thermistor 912 can satisfactorily detect the temperature of the fixing roller 910. On the other hand, when the gap (interval) is made excessively small, there is a possibility that the windbreak plate 908 contacts the pressing roller 920 due to a variation in mounting tolerance and thermal expansion of the pressing roller 920, and therefore, in Embodiment 1, the opposing interval between the windbreak plate 908 and the pressing roller 920 was set at 1.5 mm. By this, the opposing interval between the windbreak plate 908 and the pressing roller 920 was smaller than an opposing interval, of 3.0 mm, between the free end of the entrance guide 905 and the pressing roller 920 in the press-contact state of the pressing roller 920. Naturally, the opposing interval between the windbreak plate 908 and the pressing roller 920 is smaller than the opposing interval, of 6.0 mm, between the free end of the entrance guide 905 and the pressing roller 920 in the spaced state of the pressing roller 920.

Comparison Example 1

Figure 9:
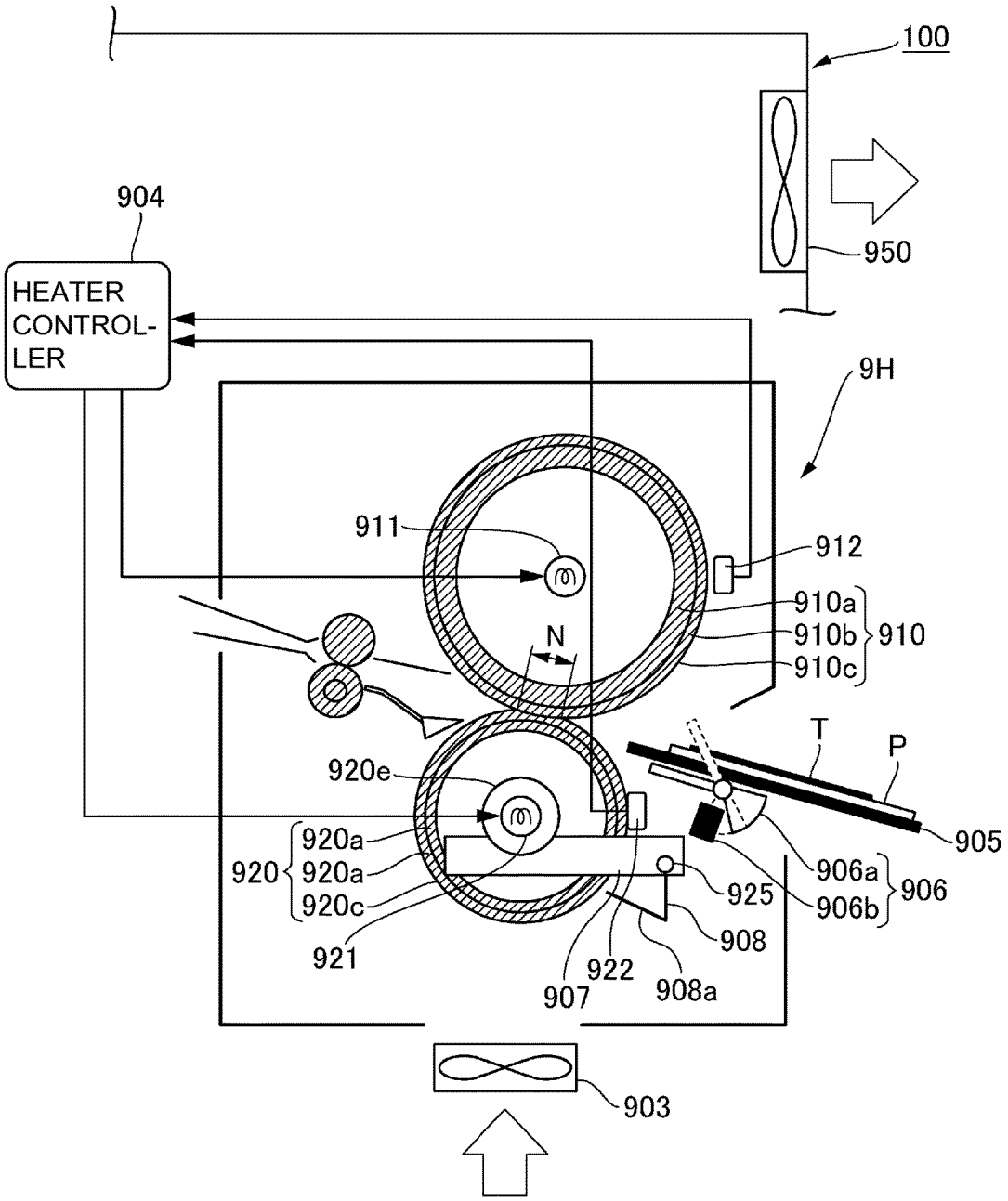
FIG. 9 is an illustration of a press-contact state of a pressing roller in fixing device in Comparison Example 1.
Figure 10:
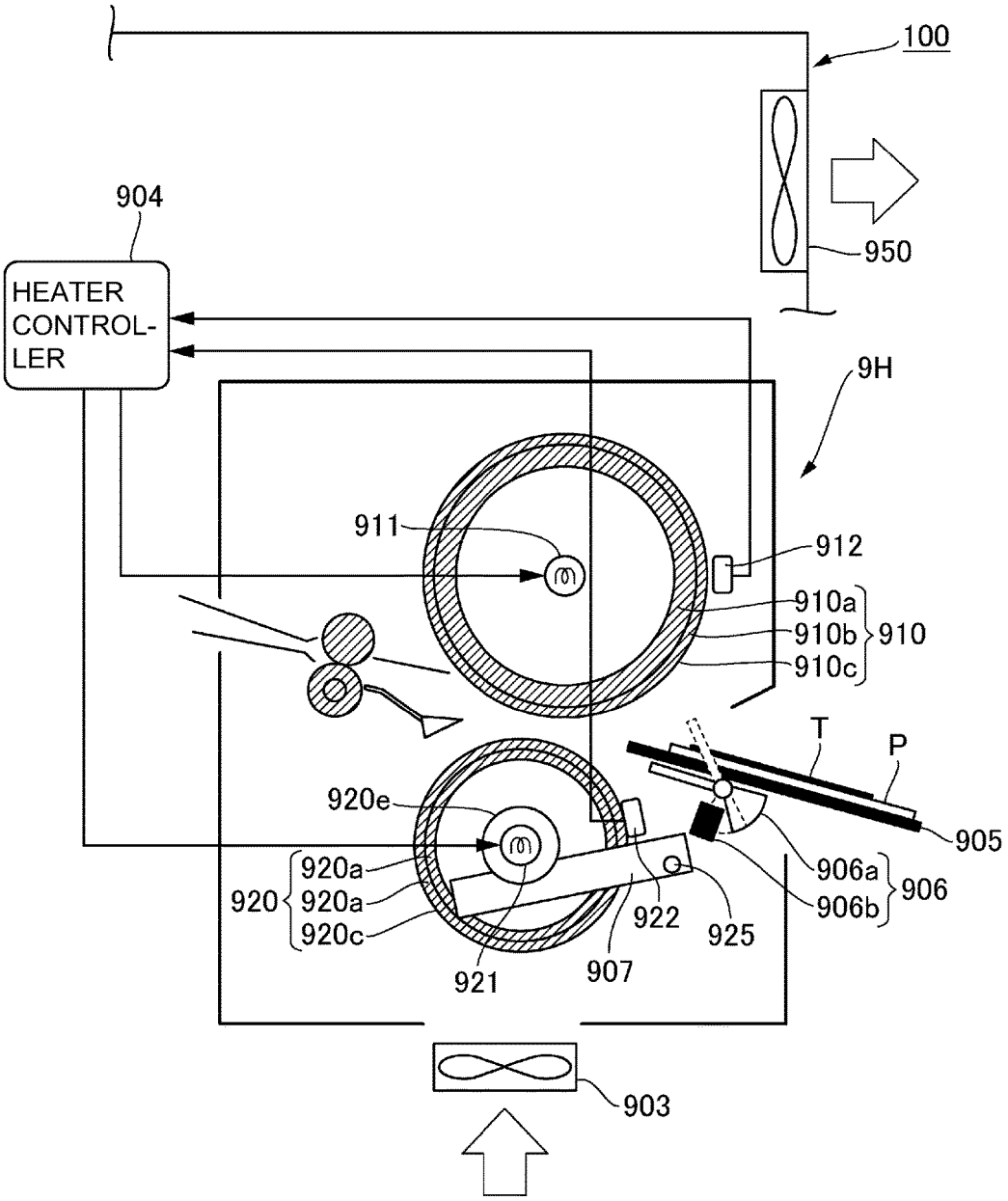
FIG. 10 is an illustration of a spaced state of the pressing roller in the fixing device in Comparison Example 1.

FIG. 9 is an illustration of a press-contact state of a pressing roller in a fixing device in Comparison Example 1. FIG. 10 is an illustration of a spaced state of the pressing roller in the fixing device in Comparison Example 1.

As shown in FIG. 9, a fixing device 9H in Comparison Example does not include the windbreak plate 908 in the fixing device of Embodiment 1 shown in FIG. 2. Other constitutions are the same as those in Embodiment 1, and therefore, in FIGS. 9 and 10, common constitutions to Embodiment 1 are represented by adding the same symbols as those in FIG. 2 and will be omitted from redundant description.

As shown in FIG. 9, during rest of the cooling fan 903, in the casing of the fixing device 9H, the air is heated by the fixing roller 910 and the pressing roller 920, so that moderate natural convection generates. The natural convection leaking out from an upper gap of the casing of the fixing device 9 is caught by the exhaust fan 950 and is discharged to an outside of the device. Here, when the cooling fan 903 is actuated, ascending air flow (current) in flow amount considerably exceeding the natural convection generates inside the casing of the fixing device 9, so that the air in a large amount is discharged to the outside of the device by the exhaust fan 950. For this reason, in the ON state of the cooling fan 903, compared with the OFF state, the cool air in a large amount passes by the side of the thermistor 912 and moves upwardly.

As shown in FIG. 10, in the case where the pressing roller 920 is spaced from the fixing roller 910, a space enlarged between the pressing roller 920 and the free end of the entrance guide 905 is formed, so that the cooled air is liable to flow into the thermistor 912.

In Comparison Example, also during the printing in which the pressing roller 920 is in the press-contact state and during the stand-by in which the pressing roller 920 is in the spaced state, the cooling fan 903 is actuated when the temperature of the pressing roller 920 excessively increases. For this reason, there is a need to prevent erroneous detection of the surface temperature of the fixing roller by blocking the air of the cooling fan 903 flowing into the thermistor 912 in the same degree even at the spaced position and the press-contact position of the pressing roller 920.

Comparison Example 2

In Embodiment 2, in the fixing device 9 shown in FIG. 2, the entrance guide 905 is attached to the pressing arm 907 and thus is constituted swingably. By this, the entrance guide 905 rotates about the rotation shaft 925, so that the gap between the free end of the entrance guide 905 and the pressing roller 920 becomes constant irrespective of the press-contact and spacing operation of the pressing roller 920. Further, there is a possibility that by extending the entrance guide 905 toward the pressing roller 920 until the opposing interval between the entrance guide 905 and the pressing roller is 1.5 mm, the air blowing of the cooling fan 903 is blocked similarly as in the constitution of Embodiment 1 and thus an object can be achieved. However, in the case where the position of the entrance guide 905 fluctuates relative to the fixing nip N, there is a liability that the fluctuation has an influence on feeding behavior of the recording material passing through the fixing nip N and generates an image defect. Further, also a constitution such as a recording material detecting portion 906 which is required to maintain a positional relationship with the entrance guide 905 has to follow a swinging operation of the entrance guide 905, so that a constitution change magnitude from the constitution of Comparison Example 1 of FIG. 9 becomes large.

Effect of Embodiment 1

In Embodiment 1, the windbreak plate 908 is disposed between the cooling fan 903 and the thermistor 912. The windbreak plate 908 causes its free end to oppose the pressing roller 920 with an opposing interval smaller than the opposing interval between the entrance guide 905 and the pressing roller 920 when the fixing roller 910 and the pressing roller 920 are spaced from each other, and blocks the air blowing of the cooling fan 903 toward the thermistor 912. Specifically, as regards the windbreak plate 908 which is an example of the plate-like member, the length thereof with respect to the rotational axis direction of the pressing roller 920 is a length such that the air blowing of the cooling fan 903 does not move around both ends of the windbreak plate 908 with respect to the rotational axis direction of the pressing roller 920 and does not reach the thermistor 912. For this reason, the air blowing from the cooling fan 903 toward the thermistor 912 is effectively blocked by the windbreak plate 908. The windbreak plate 908 efficiently blocks the air blowing of the cooling fan 903 toward the thermistor 912 more than the entrance guide 905.

In Embodiment 1, the pressing arm 907 which is an example of a moving mechanism moves the pressing roller 920 toward and away from the fixing roller 910. The pressing arm 907 which is an example of an interrelating mechanism has a structure such that the pressing arm 907 moves the windbreak plate 908 with the rotational movement of the pressing arm 907 and maintains an opposing distance between the free end of the windbreak plate 908 and the pressing roller 920 at a constant value. For this reason, even in the spaced state and in the contact state, the thermistor 912 does not generate disturbance due to the air blowing of the cooling fan 903 toward the thermistor 912. The temperature of the fixing roller 910 is detected with high accuracy, so that it becomes possible to effect accurate temperature control. Even when the pressing roller 920 is in either of the press-contact and spaced positions, it is possible to suppress arrival of the cooled air at the thermistor 912, so that the surface temperature of the fixing roller 910 can be satisfactorily between the fixing roller 910 surface temperature irrespective of the operation of the cooling fan 903.

In Embodiment 1, the pressing arm 907 is a lever member for moving the pressing roller 920 toward and away from the fixing roller 910 by rotating about a rotation shaft fixed in a positional relationship with the fixing roller 910 while supporting a rotation shaft of the pressing roller 920. The windbreak plate 908 has a structure disposed fixedly in the positional relationship with the pressing arm 907. For this reason, the number of parts is small, so that the fixing device can be constituted in a small size. A mechanism exclusively for moving the windbreak plate 908 is not needed. The windbreak plate 908 is fixed to the pressing arm 907, and therefore, irrespective of the position of the pressing roller 920, the gap between the pressing roller 920 and the windbreak plate 908 is unchanged, so that the same effect can be obtained.

In Embodiment 1, the thermistor 912 is a thermistor element of a non-contact type in which the thermistor is disposed with a gap from the peripheral surface of the fixing roller 910. For this reason, the rubbing scars are not generated on the fixing roller, and the thermistor 912 is prevented from running against a jammed sheet and from being positionally deviated. It is possible to detect the temperature of the fixing roller 910 with high sensitivity and high responsiveness.

In Embodiment 1, the windbreak plate 908 opposes the pressing roller 920 at its free end between the thermistor 922 and the entrance guide 905 with respect to the rotational direction of the pressing roller 920. For this reason, a wide area, of the pressing roller 920, including a disposing region of the thermistor 922 is cooled by the cooling fan 903.

Embodiment 2

Figure 6:
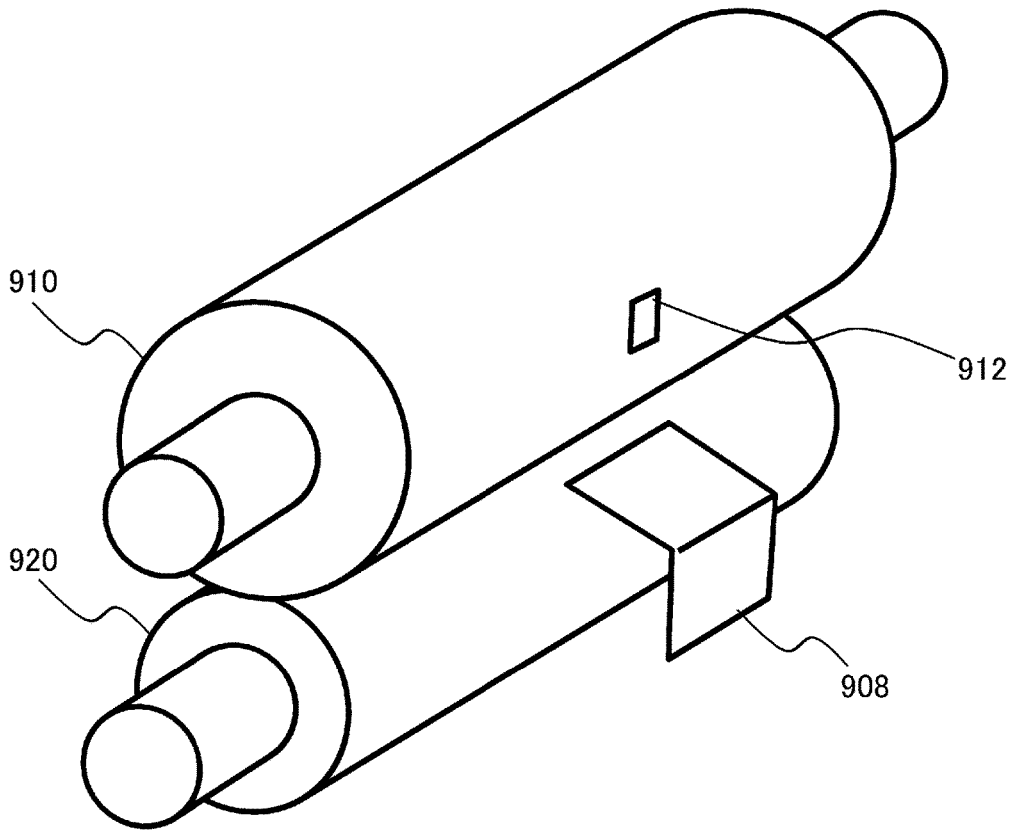
FIG. 6 is an illustration of an arrangement of a windbreak plate in Embodiment 2.
Figure 7:
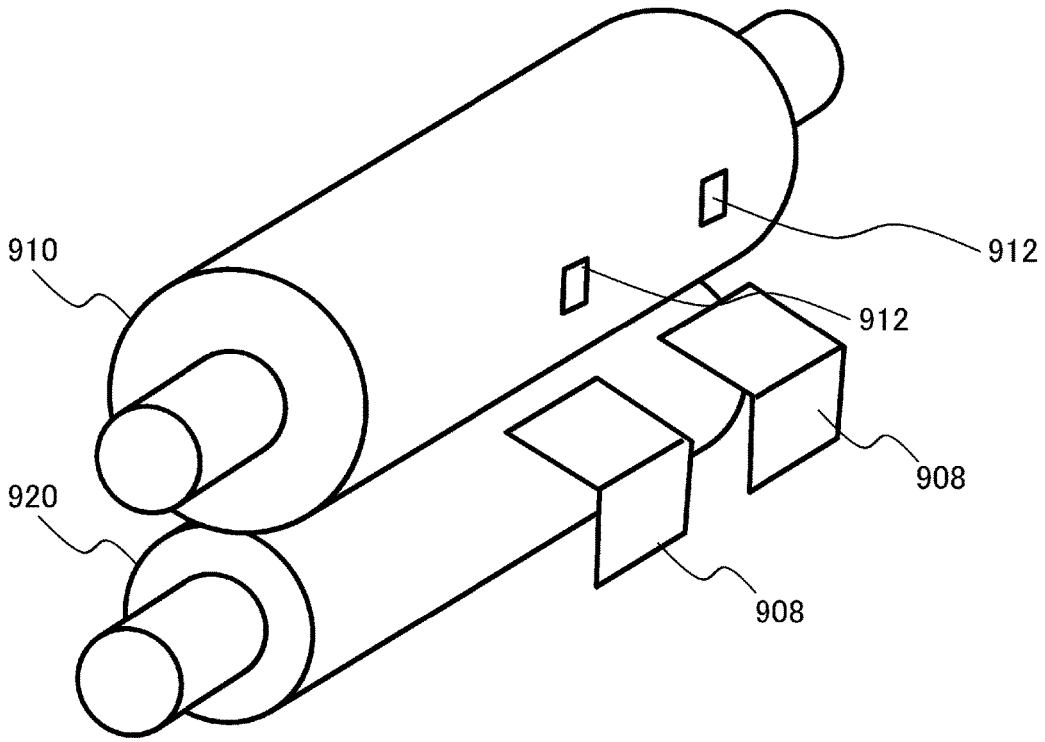
FIG. 7 is an illustration of a modified embodiment in which two thermistor are provided.

FIG. 6 is an illustration of an arrangement of a windbreak plate in Embodiment 2. FIG. 7 is an illustration of a modified Embodiment in which two thermistors are provided. As shown in FIG. 6, a fixing device 9 in Embodiment 2 is the same as the fixing device in Embodiment 1 shown in FIG. 5 except that a shielding range of the windbreak plate 908 is different, and therefore in FIG. 6, constituent members common to those in Embodiment 1 are represented by the same symbols and will be omitted from redundant description.

In Comparison Example 1 shown in FIG. 9, there is no windbreak plate (908), and therefore a flow amount of the air flowing along the pressing roller 920 increases, so that cooling efficiency of the pressing roller 920 becomes high.

As shown in FIG. 6, in Embodiment 2, compared with Embodiment 1, a length of the windbreak plate 908 with respect to the rotational axis direction of the pressing roller 920 is shortened and the shielding range of the windbreak plate 908 is limited to a periphery of the position where the thermistor 912 is disposed. For this reason, when compared with comparison example 1 shown in FIG. 9, cooling efficiency of the pressing roller 920 lowers, but the cooling efficiency is higher than that in Embodiment 1 shown in FIG. 5.

Incidentally, as shown in FIG. 7, in the case where the thermistor 912 is disposed at the plurality of positions of the fixing roller 910, the windbreak plate 908 is disposed at a plurality of portions with respect to the rotational axis direction of the pressing roller 920 correspondingly to the arrangement of the respective thermistors 912.

In either case, in Embodiment 2, as shown in FIG. 2, the windbreak plate 908 is, similarly as in Embodiment 1, fixed in the positional relationship with the pressing arm 907 rotating integrally with the pressing roller 920 about the rotation shaft 925. As a result, the gap between the free end of the windbreak plate 908 and the pressing roller 920 is unchanged between the press-contact state and the spaced state of the pressing roller 920 relative to the fixing roller 910, so that the windbreak plate 908 can shield the air blowing of the cooling fan 903 toward the thermistor 912 so as to be the same level. Irrespective of the ON/OFF of the cooling fan 903 and the press-contact/spacing of the pressing roller 920, by eliminating the influence of the air blowing of the cooling fan 903 on the detection temperature of the thermistor 912, the actual surface temperature of the fixing roller 910 can be maintained at constant levels.

As described above, in Embodiment 2, as regards the windbreak plate 908, the range, with respect to the rotational axis direction of the pressing roller 920, in which the windbreak plate 908 shields the air blowing of the cooling fan 903 flowing in the rotational direction of the pressing roller 930 is less than a length of the windbreak plate 908 with respect to the rotational axis direction of the pressing roller 920. Specifically, the length is 160 mm which is an example of not more than ½ of a length of 400 mm of the pressing roller 920. By this, not only a heat removing performance for the entire pressing roller 920 by the cooling fan 903 is enhanced, but also there is an effect on cooling for the non-sheet-passing portion temperature rise such that the end portion temperature of the fixing roller 910 rises.

Embodiment 3

Figure 8:
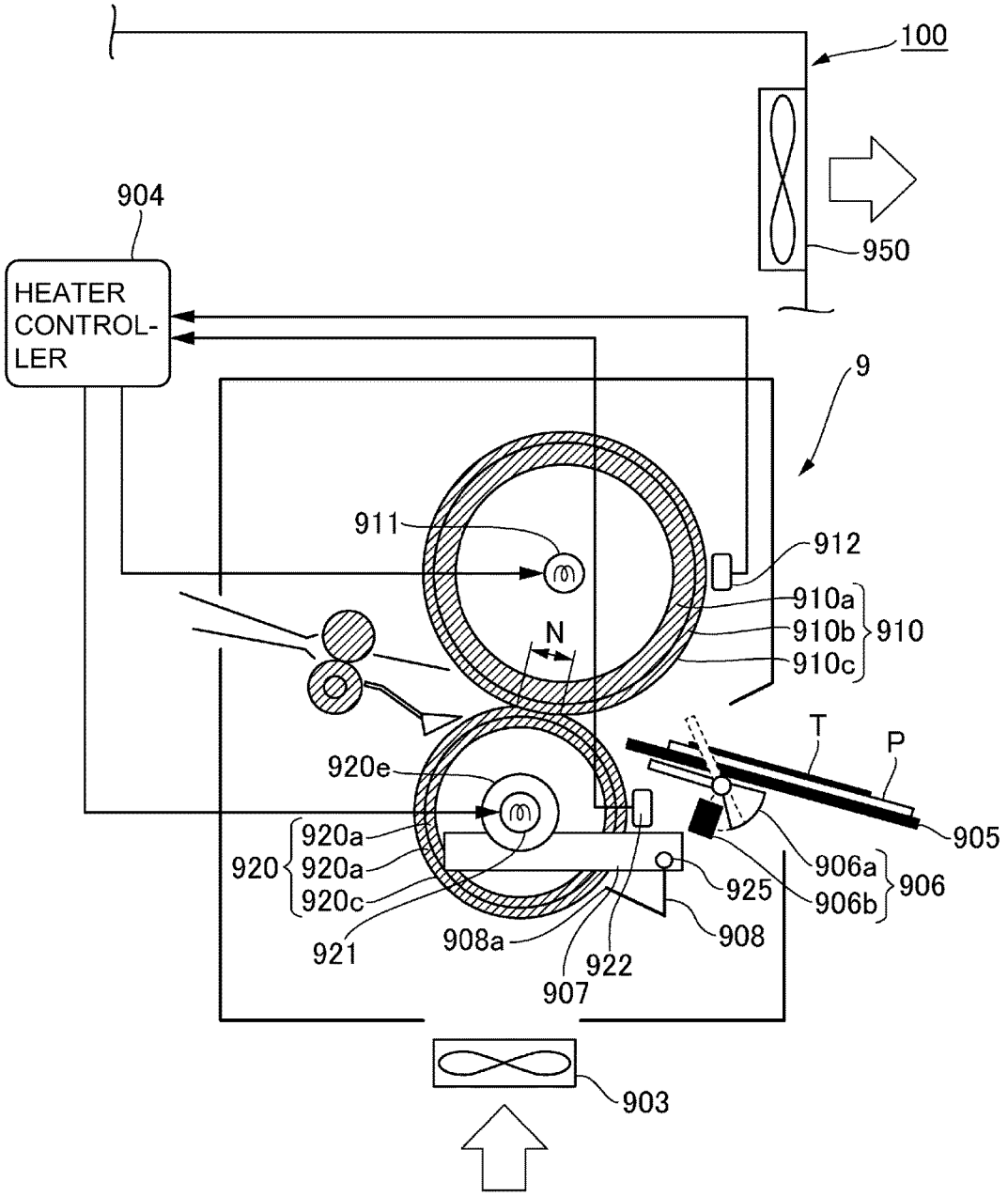
FIG. 8 is an illustration of an arrangement of a windbreak plate in Embodiment 3.

FIG. 8 is an illustration of an arrangement of a windbreak plate in Embodiment 3. As shown in FIG. 8, a fixing device 9 in Embodiment 3 is the same as the fixing device in Embodiment 1 shown in FIG. 2 except that an arrangement and a shape of the windbreak plate 908 are different and that the thermistor 922 for detecting the surface temperature of the pressing roller 920 is disposed in the non-contact type. For this reason, in FIG. 8, constituent members common to those in Embodiment 1 are represented by the same symbols in FIG. 2 and will be omitted from redundant description.

As described above, compared with the fixing roller 910, the surface temperature of the pressing roller 920 so as to below, and therefore, scars generated on the pressing roller 920 are not readily transferred onto the image. However, in recent years, with speed-up of the image forming apparatus, a low melting point of the toner is advanced so as to carry out fixing with a lower heat quantity, and therefore, the toner is melted even by the pressing roller 920 low in temperature, so that the scars are liable to be transferred onto the image surface. For that reason, in Embodiment 3, for the thermistor 922 for detecting the temperature of the pressing roller 920, the non-contact type which is the same as that for the fixing roller 910 was selected.

Further, the windbreak plate 908 was disposed between the cooling fan 903 and the thermistor 922, so that also the flowing of the cooled air into the thermistor 922 for detecting the surface temperature of the pressing roller 920 was able to be suppressed.

In Embodiment 3, the windbreak plate 908 is, similarly as in Embodiment 1, fixed in the positional relationship with the pressing arm 907 rotating integrally with the pressing roller 920 about the rotation shaft 925. As a result, the gap between the free end of the windbreak plate 908 and the pressing roller 920 is unchanged between the press-contact state and the spaced state of the pressing roller 920 relative to the fixing roller 910, so that the windbreak plate 908 can shield the air blowing of the cooling fan 903 toward the thermistor 912 so as to be the same level. Irrespective of the ON/OFF of the cooling fan 903 and the press-contact/spacing of the pressing roller 920, by eliminating the influence of the air blowing of the cooling fan 903 on the detection temperature of the thermistor 912, the actual surface temperature of the fixing roller 910 can be maintained at constant levels.

In Embodiment 3, as regards the windbreak plate 908, the range, between the thermistor 922 and the cooling fan 903 with respect to the rotational axis direction of the pressing roller 920, the free end of the windbreak plate 908 is caused to oppose the pressing roller 920.

In Embodiment 3, a proportion that the windbreak plate 908 covers the surface of the pressing roller 920 with respect to the rotational direction of the pressing roller 920 becomes large compared with Comparison Example 1, and therefore, there is a liability that cooling efficiency of the pressing roller 920 by the cooling fan 903 lowers. For that reason, as shown in FIG. 6 or 7, the length of the windbreak plate 908 with respect to the rotational axis direction of the pressing roller 920 is shortened, so that the shielding range of the windbreak plate 908 is limited to the periphery of the position where the thermistor 912 is disposed.

In Embodiment 3, to both of the thermistor 912 and the thermistor 922, the air blowing of the cooling fan 903 can be shielded in the same degree irrespective of the turning-on/off of the cooling fan 903 and the press-contact/spacing of the pressing roller 920. For this reason, even when the thermistor 922 is high in responsiveness and low in disturbance as the non-contact type, temperature adjustment of the pressing roller 920 can be accurately maintained irrespective of the turning-on/off of the cooling fan 903 and the press-contact/spacing of the pressing roller 920.

Other Embodiments

The above-described Embodiments 1 to 3 are merely an example of the embodiments of the present invention, and the present invention is not limited to the constitutions and the control in the above-described Embodiments 1 to 3.

Whether the constitution of Embodiment 1 is employed or the constitution of Embodiment 2 is employed can be selected depending on air blowing power of the cooling fan 903 and the responsiveness of the thermistor used.

In Embodiments 1 to 3, as the rotatable heating member and the rotatable pressing member, the roller member is used in either case, but either one or both of the rotatable heating member and the rotatable pressing member may also be replaced with another rotatable member such as an endless belt member stretched by a plurality of stretching roller.

In Embodiments 1 to 3, as the detecting portion, the non-contact-type thermistor was employed, but a thermopile, a thermocouple, a semiconductor element, other temperature sensors, and the like may also be employed. These may be of a contact type.

In Embodiment 1, the opposing distance between the windbreak plate 908 and the pressing roller 920 was 1.5 mm, but setting of the gap between the windbreak plate 908 and the pressing roller 920 may appropriately be changed depending on the constitution of the fixing device 9, the air blowing amount of the cooling fan 903 and the responsiveness of the thermistor 912.

INDUSTRIAL APPLICABILITY

According to the present invention, it is possible to provide a fixing device capable of properly carrying out temperature control of the pressing roller.

The invention claimed is:

1. A fixing device comprising:

a rotatable heating member and a rotatable pressing member configured to form a nip for fixing a toner image on a recording material;

a detecting portion configured to detect a temperature of said rotatable heating member;

a guiding portion configured to guide the recording material toward the nip while sliding on a back surface of the recording material;

a moving mechanism configured to move said rotatable pressing member relative to said rotatable heating member and said guiding portion so that said rotatable pressing member is movable between a first position where said rotatable pressing member contacts said rotatable heating member and a second position where said rotatable pressing member is spaced from said rotatable heating member and is further spaced from said guiding portion;

an air blowing portion configured to blow air toward said rotatable pressing member from a side, with respect to a recording material feeding path including the nip, where said rotatable pressing member is provided; and a suppressing portion configured to suppress blowing of the air from said air blowing portion toward said detecting portion through between said guiding portion and said rotatable pressing member, said suppressing portion including an opposing portion that is positioned between said guiding portion and a peripheral surface of said rotatable pressing member and that opposes the peripheral surface of said rotatable pressing member taking the second position with a distance narrower than a distance between the peripheral surface of said rotatable pressing member taking the second position and said guiding member.

2. A fixing device according to claim 1, further comprising a heating portion configured to heat said rotatable heating member and a controller configured to control energization to said heating portion depending on an output of said detecting portion, wherein, when said rotatable pressing member is in the second position, said controller controls the energization to said heating portion so that a temperature of said rotatable heating member is a predetermined temperature.

3. A fixing device according to claim 1, wherein said suppressing portion moves together with said rotatable pressing member between the first position and the second position by said moving mechanism.

4. A fixing device according to claim 1, wherein said detecting portion is provided outside of said rotatable heating member and is provided spaced from an outer surface of said rotatable heating member.

5. A fixing device according to claim 1, wherein said suppressing portion is a black painted plate-like member.

6. A fixing device according to claim 1, wherein, when a temperature of said rotatable heating member is not less than a predetermined temperature, said air blowing portion blows the air toward said rotatable pressing member.

7. A fixing device according to claim 1, wherein the distance between said opposing portion and the peripheral surface of said rotatable pressing member taking the second position is 2.0 mm or less.

8. A fixing device according to claim 1, wherein said rotatable pressing member is an endless belt supported by a plurality of rollers.

* * * * *